US007025355B1

(12) United States Patent
Peters

(10) Patent No.: US 7,025,355 B1
(45) Date of Patent: Apr. 11, 2006

(54) CAN KICKING GAME AND METHOD OF PLAY

(76) Inventor: Clifford B. Peters, 1700 N. Dupont Hwy., Apt. G202, Dover, DE (US) 19901

( * ) Notice: Subject to any disclaimer, the term of this patent is extended or adjusted under 35 U.S.C. 154(b) by 0 days.

(21) Appl. No.: 10/942,566

(22) Filed: Sep. 17, 2004

(51) Int. Cl.
*A63B 67/00* (2006.01)

(52) U.S. Cl. ..... 273/441; 273/400

(58) Field of Classification Search ..... 273/398–402, 273/440, 441, 108, 117 R
See application file for complete search history.

(56) References Cited

U.S. PATENT DOCUMENTS 3,580,578 A * 5/1971 McCarthy ..... 473/471
3,642,285 A * 2/1972 Impastato ..... 273/243
3,742,642 A * 7/1973 Zegers-Ten Horn ..... 434/430
3,960,379 A * 6/1976 Maloney et al. ..... 273/317
4,923,201 A * 5/1990 Nichol et al. ..... 273/371
5,690,565 A * 11/1997 Swanson ..... 473/417
6,860,825 B1 * 3/2005 Clark ..... 473/478
2004/0038759 A1 * 2/2004 Kuzia et al. ..... 473/478

* cited by examiner

*Primary Examiner*—Mark S. Graham

(57) ABSTRACT

A can kicking game which includes a substantially rectangular playing surface, a goal area having a goal housing subdivided into a plurality of spaces and open to the playing surface, a random chance generator, a can positionable on the playing surface, a plurality of instruction cards providing instructions to players on a turn-by-turn basis. Each player in turn draws an instruction card, positioned and kicks the can towards the goal housing in accordance with instructions on the instruction card, and adjusts their score based upon the results of the kick. The game is won by the player accumulating more points than all other players within a predetermined number of turns.

18 Claims, 2 Drawing Sheets

CAN KICKING GAME AND METHOD OF PLAY

BACKGROUND OF THE INVENTION

The present invention relates to dexterity enhancing games and more particularly pertains to a new can kicking game and method of play for stimulating the mind and honing the thought process of the players, strengthening foot-eye coordination, and encouraging positive social and family interaction through good-natured competition.

DESCRIPTION OF THE PRIOR ART

The use of dexterity enhancing games is known in the prior art. Illustrative examples include: U.S. Pat. No. 3,742,642; U.S. Pat. No. 3,960,379; and U.S. Pat. No. 4,923,201.

SUMMARY OF THE INVENTION

A game of strategy and skill, this can kicking game and method of play is based on the time-honored amusement of kicking an object down a city street and trying to place into an open storm drain or pigeon hole. Appropriate for children as well as adults, this game was created for up to six (6) players, ages 5 and older. The game is basically comprised of a measured, flat playing surface, raised area with divided compartments, three (3) decks of playing cards, plastic renderings of "creepy things," a set of dice, and a tin can for kicking. Manufactured of a durable plastic material and rectangular in shape, the flat playing surface would measure approximately six feet (6') in length and forty inches (40") in width. This surface would feature marked divisions at twelve-inch (12") intervals, designating the measured distance from the compartment goals to the start of the playing area. Measuring approximately seventeen inches (17") in length, forty inches (40") in width, and seven inches in height, the goal area could feature up to seven recessed, divided compartments. Located on the top of the goal area, a circular covered opening, or "man hole," would be centrally positioned to allow ingress into the compartments. The decks of playing cards would consist of instruction cards, specialty cards, and toss-in cards. The instruction cards could instruct players on the type of kick to use during play, such as heel, side, or toe kicks. Additionally, these cards could feature the designated distance from which to attempt the kick, as well as the number of points awarded for a successful kick. The specialty and toss-in cards could be included with the game to offer other interesting challenges. Plastic pieced representing a millipede, a spider, a rat, and even a fish would also be included with game to represent "creepy things" that can be encountered when retrieving a can from the "storm drain." The dice would be the standard variety common to most games, while the can would be the regular aluminum common to beverage cans. As an additional consideration, players could appropriate empty cans from the household for extras during play.

Play of the game would be very simple, fun, and straightforward. First, the dice would be rolled to determine which player would go first, with the highest numbered roll as the deciding factor. The starting player would then choose an instruction card to discover his first kicking challenge. By way of example, the card could instruct the player to use a toe kick to place the can into the center pigeon hole, from a distance of five feet. Should the player accomplish the task, he would be awarded the number of points designated by the card for that particular kick. Opening the "man hole" to retrieve the can for the next kicker, play would continue in a similar fashion. The specialty and toss in cards could be consulted during play to infuse the game with interesting challenges and strategies, the specifics of which will be later determined by the inventor. Additionally, when players score goals, they could encounter a "creepy" wile retrieving the can from the man hole, which could result in a loss of points. Play would continue for as long as the players desire, or until a predetermined point value has been reached and a winner was declared.

There are several significant benefits and advantages associated with this can kicking game and method of play. Foremost, this thrilling game would offer consumers hours of competitive and challenging fun. A game of strategy and skill, the game would provide players with a means of stimulating the mind and honing their thought process. Additionally, play of this game would effectively allow players to strengthen foot-eye coordination. Offering a reprieve from the stresses of daily life, this exciting game would encourage positive social and family interaction through good-natured competition. With simple to follow instructions and easy to use components, the game could be enjoyed by children as well as adults. Adults especially would treasure the feelings of nostalgia this game would foster, and relish in the opportunity to share an activity they enjoyed as children with their own children and grandchildren. Consumers should also appreciate the versatility of the game, as it could be played indoors or out. Featuring durable, weather-resistant plastic construction, this game would withstand years of continued use and play.

This can kicking game and method of play is a cleverly designed product that would offer players a fun and interactive game of strategy. Both simple and challenging, this entertaining game would effectively foster camaraderie and competition as it is played.

To this end, the present invention generally comprises a substantially rectangular playing surface, a goal area having a goal housing subdivided into a plurality of spaces and open to the playing surface, a random chance generator, a can positionable on the playing surface, a plurality of instruction cards providing instructions to players on a turn-by-turn basis. Each player in turn draws an instruction card, positioned and kicks the can towards the goal housing in accordance with instructions on the instruction card, and adjusts their score based upon the results of the kick. The game is won by the player accumulating more points than all other players within a predetermined number of turns.

There has thus been outlined, rather broadly, the more important features of a method of playing a can kicking game in order that the detailed description thereof that follows may be better understood, and in order that the present contribution to the art may be better appreciated. There are additional features of the method of playing a can kicking game that will be described hereinafter and which will form the subject matter of the claims appended hereto.

In this respect, before explaining at least one embodiment of the method of playing a can kicking game in detail, it is to be understood that the method of playing a can kicking game is not limited in its application to the details of construction and to the arrangements of the components set forth in the following description or illustrated in the drawings. The method of playing a can kicking game is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present method of playing a can kicking game. It is important, therefore, that the claims be regarded as including such equivalent constructions insofar as they do not depart from the spirit and scope of the present invention.

It is another object of the present invention to provide a method of playing a can kicking game which has all of the advantages of the prior art and none of the disadvantages.

It is another object of the present invention to provide a method of playing a can kicking game which may be easily and efficiently manufactured and marketed.

It is another object of the present invention to provide a method of playing a can kicking game which is of durable and reliable construction.

It is yet another object of the present invention to provide a method of playing a can kicking game which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
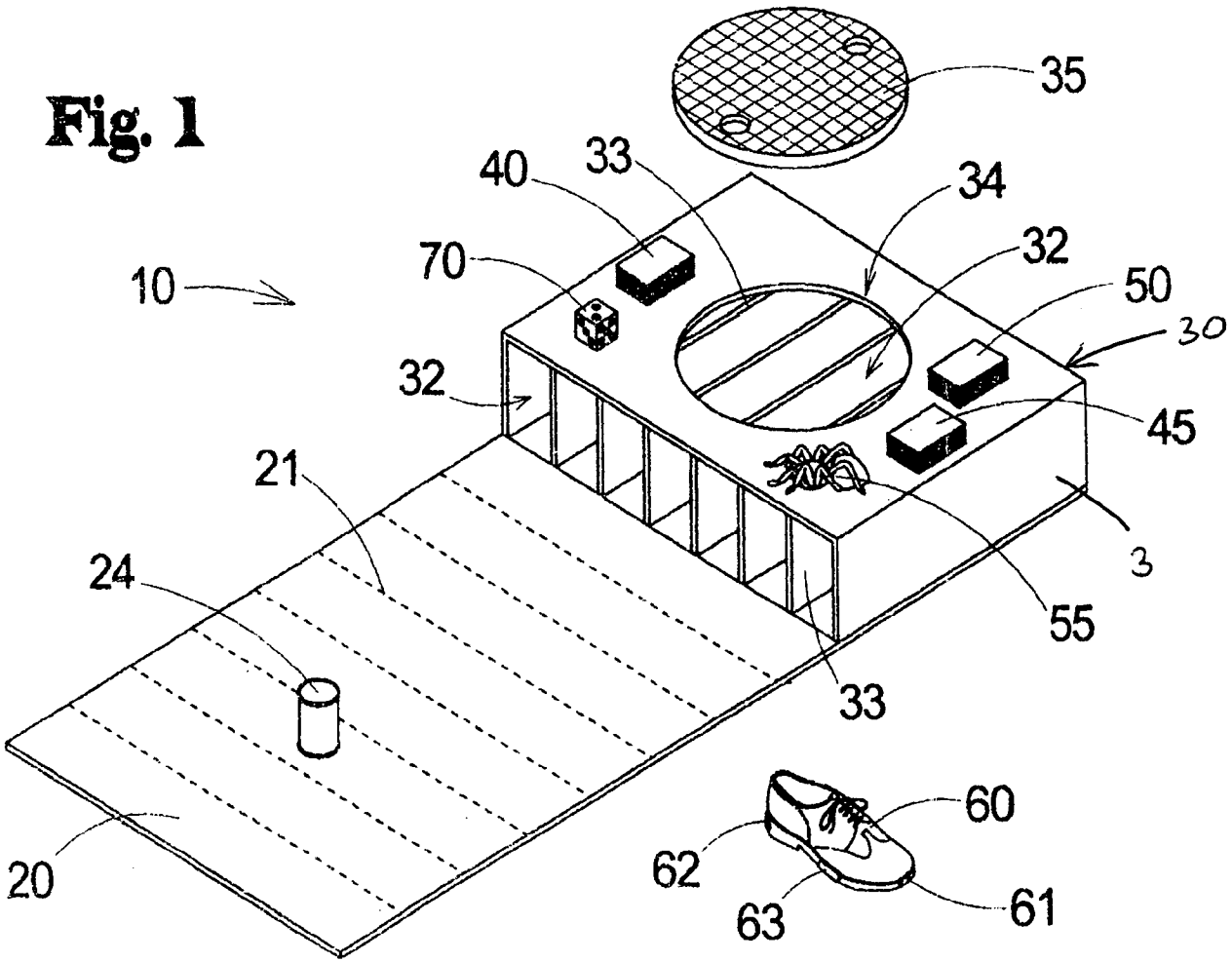
FIG. 1 is a schematic perspective view of a new can kicking game according to the present invention.
Figure 2:
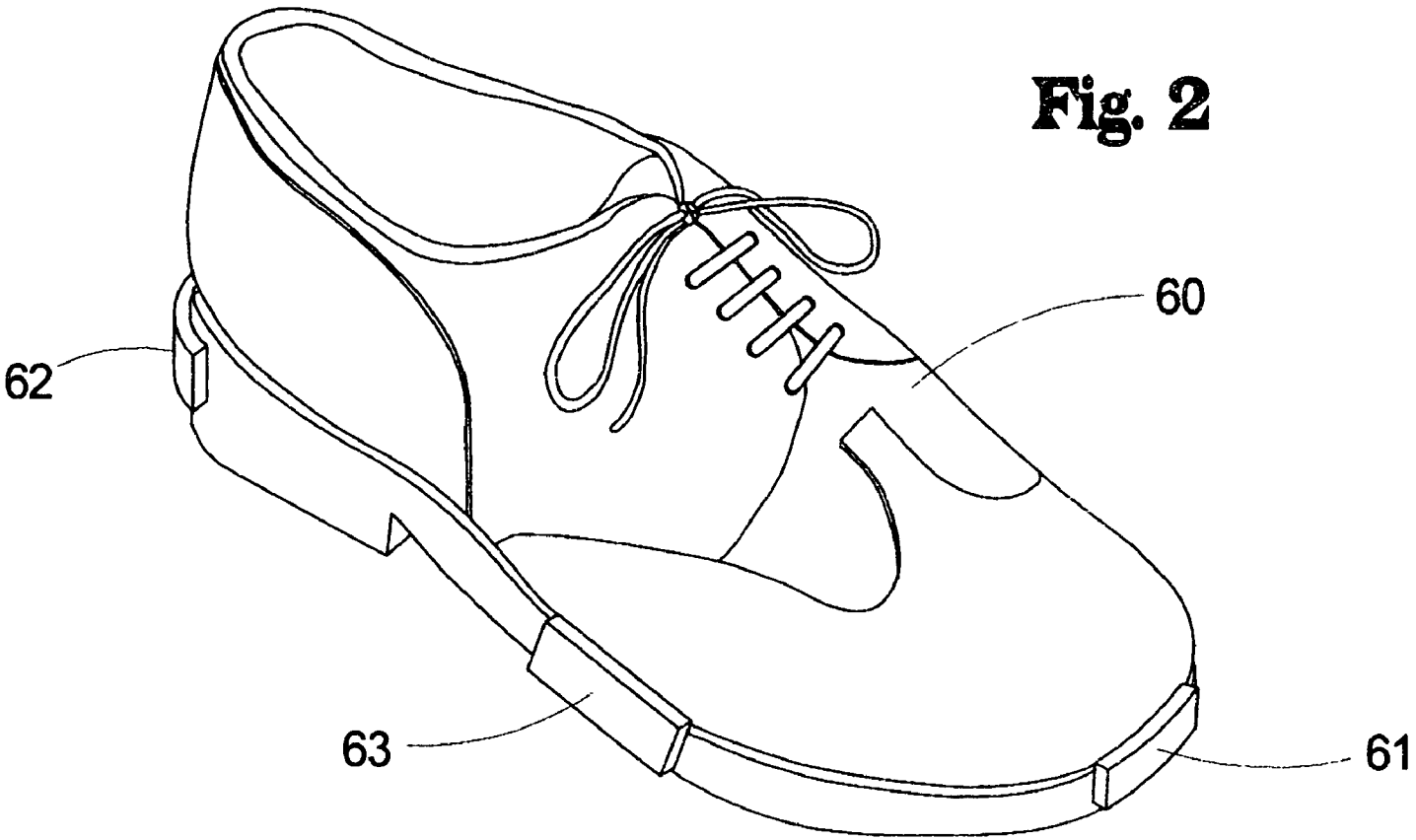
FIG. 2 is a schematic top view of the shoe of the present invention.

With reference now to the drawings, and in particular to FIGS. 1 and 2 thereof, a new can kicking game and method of play embodying the principles and concepts of the present invention and generally designated by the reference numeral 10 will be described.

As best illustrated in FIGS. 1 and 2, the can kicking game and method of play 10 generally comprises a playing surface 20, a goal area 30 with a goal housing 31, a can 24, chance means 70, and a plurality of instruction cards 40.

Preferably the playing surface 20 is substantially rectangular with plurality of indicia 21 representing a potential location for placing the can 24 to be kicked. Preferably the indicia 21 are distributed in twelve inch increments, but other distributions do not depart from the spirit and scope of the invention.

The goal area 30 is positioned at one end of the playing surface 20. Preferably, the goal housing 31 comprising a top wall, a back wall, and a pair of side walls.

In an embodiment the goal housing 31 is subdivided into seven of spaces 32 by six intermediate walls 33. Each one of said seven of spaces 32 is open to a front of the goal housing 31 facing the playing surface 20. The goal housing 31 further comprises a central access opening 34 and a cover member 35. The central access opening 34 facilitates retrieving the can 24 after each turn. The cover member 35 is used for selectively closing the central access opening 34.

Conventional die are the preferred chance means 70, however, other conventional chance means 70 may be used with satisfactory results and without departing from the scope and spirit of the invention.

The can 24 is a conventional beverage can and can adequately be replaced with an empty beverage can after consumption of the content.

The instruction cards 40 provide instructions to players on a turn-by-turn basis. The instruction cards 40 may provide an initial orientation for positioning the can 24 prior to kicking. These orientations include upright, sideways, and prone. The instruction cards 40 may also provide a style of kick for kicking the can 24 including toe kick, heel kick, and side kick. Additionally the instruction cards 40 may also provide a distance of kick corresponding to an indicia 21 on the playing surface 20.

A plurality of toss-in cards 45 may also be provided to vary the style of play. Each one of said toss-in cards 45 may describe an alternate method of scoring and providing instructions for executing the alternate method. Additionally, each one of the plurality of toss-in cards 45 may also provide an adjustment of the score for either successfully completing the alternate method or failing to complete the alternate method.

In at least one embodiment, a plurality of specialty cards 50 is also provided. Each one of the specialty cards 50 provides an adjustment of the score based upon matching a criterion listed on the specialty card 50.

In a further embodiment, at least one shoe 60 to be worn by at least one player is provided to facilitate kicking the can 24. The shoe 60 preferably further comprises a front flat portion 61 operationally coupled to a toe portion of the conventional shoe, a rear flat portion 62 operationally coupled to a heel portion of the conventional shoe, and a pair of side flat portions 63 each operationally coupled to an associated side of the conventional shoe adjacent to a ball portion of the conventional shoe.

In a further embodiment, a plurality of iconic members 55 representing "creepy" things is also provided. Each one of the iconic members 55 is positionable in an associated one of the spaces 32 of the goal housing 31. Illustrative examples of the iconic members 55 include a "rat", a "millipede", a "spider" and a "fish".

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a can kicking game comprising the steps of:

(a) providing a playing surface, said playing surface being substantially rectangular, (b) providing a goal area positioned at one end of said playing surface, said goal area including a goal housing comprising a top wall, a back wall, and a pair of side walls, (c) providing a chance means, (d) providing a can, said can being positionable along said playing surface, (e) providing a plurality of instruction cards, said instruction cards providing instructions to players on a turn-by-turn basis, (f) using said chance means to determine an order of play for said players, (g) drawing an instruction card, (h) positioning said can along said playing surface as instructed by said instruction card, (i) kicking said can as instructed by said instruction card, (j) adjusting a score based upon results of kicking said can, (k) retrieving said can, (l) wherein each of said players takes turns drawing instruction cards and kicking said can according to said instruction card, and (m) winning the game by accumulating more points than other players within a predetermined number of turns.

2. The method of claim 1, wherein said goal housing is subdivided into a plurality of spaces by at least one intermediate wall, each one of said plurality of spaces being open to a front of said goal housing facing said playing surface.

3. The method of claim 2, wherein said goal housing further comprises:

(a) a central access opening facilitating retrieving said can after each turn, (b) a cover member for selectively closing said central access opening.

4. The method of claim 3, wherein said goal housing further comprises six intermediate walls defining seven spaces.

5. The method of claim 2, wherein said goal housing has an overall length of approximately seventeen inches, and overall width of approximately forty inches, and an overall height of approximately seven inches.

6. The method of claim 1, wherein said playing surface further comprises a plurality of indicia, each one of said plurality of indicia representing a potential location for placing said can to be kicked.

7. The method of claim 6, wherein said plurality of indicia being dispersed in twelve inch increments along a length of aid playing surface.

8. The method of claim 1, further wherein said goal housing is subdivided into a plurality of spaces by at least one intermediate wall, each one of said plurality of spaces being open to a front of said goal housing facing said playing surface, further wherein said goal housing further comprises a central access opening and a cover member, said central access opening facilitating retrieving said can after each turn, said cover member for selectively closing said central access opening, and further wherein said playing surface further comprises a plurality of indicia, each one of said plurality of indicia representing a potential location for placing said can to be kicked.

9. The method of claim 8, further comprising the steps of:

(a) providing a plurality of iconic members, each one of said iconic members being positionable in an associated one of said plurality of spaces of said goal housing, (b) distributing each one of said iconic members in associated spaces of said goal housing prior to playing an initial turn, (c) retrieving one of said plurality of iconic members upon failing to successfully kick said can and said can leaves said playing surface, and (d) adjusting said score based upon which iconic member is encountered.

10. The method of claim 8, further comprising the steps of:

(a) providing a plurality of toss-in cards, each one of said toss-in cards describing an alternate method of scoring and providing instructions for executing said alternate method, each one of said plurality of toss-in cards providing an adjustment of said score for either successfully completing said alternate method or failing to complete said alternate method, (b) drawing one of said plurality of toss-in cards, and (c) following instructions provided on said toss-in card.

11. The method of claim 8, further comprising the steps of:

(a) providing a plurality of specialty cards, each one of said specialty cards providing an adjustment of said score based upon matching a criterion listed on said specialty card, (b) drawing one of said plurality of specialty cards, (c) following instructions provided on said specialty card.

12. The method of claim 8 further comprising the step of providing at least one shoe to be worn by at least one player, said shoe facilitating kicking said can.

13. The method of claim 12, wherein said shoe further comprises a plurality of flat portions operationally coupled to a conventional shoe, said flat portions providing an even surface for contacting said can during kicking.

14. The method of claim 13, wherein said shoe further comprises a front flat portion operationally coupled to a toe portion of the conventional shoe, a rear flat portion operationally coupled to a heel portion of the conventional shoe, and a pair of side flat portions each operationally coupled to an associated side of the conventional shoe adjacent to a ball portion of the conventional shoe.

15. The method of claim 1, wherein said instruction cards providing an initial orientation for positioning said can prior to kicking, said orientation consisting of an orientation selected from the group of orientations including upright, sideways, and prone.

16. The method of claim 1, wherein said instruction cards providing a style of kick for kicking said can, said style consisting of a style selected from the group of style including toe kick, heel kick, and side kick.

17. The method of claim 1, wherein said instruction cards providing a distance of kick corresponding to an indicia on said playing surface.

18. A method of playing a can kicking game comprising the steps of:

(a) providing a playing surface, said playing surface being substantially rectangular, said playing surface further comprises a plurality of indicia, each one of said plurality of indicia representing a potential location for placing said can to be kicked, (b) providing a goal area positioned at one end of said playing surface, said goal area including a goal housing comprising a top wall, a back wall, and a pair of side walls, said goal housing is subdivided into seven of spaces by six intermediate walls, each one of said seven of spaces being open to a front of said goal housing facing said playing surface, said goal housing further comprises a central access opening and a cover member, said central access opening facilitating retrieving said can after each turn, said cover member for selectively closing said central access opening, (c) providing a chance means, (d) providing a can, said can being positionable along said playing surface, (e) providing a plurality of instruction cards, said instruction cards providing instructions to players on a turn-by-turn basis, said instruction cards providing an initial orientation for positioning said can prior to kicking, said orientation consisting of an orientation selected from the group of orientations including upright, sideways, and prone, said instruction cards providing a style of kick for kicking said can, said style consisting of a style selected from the group of style including toe kick, heel kick, and side kick, said instruction cards providing a distance of kick corresponding to an indicia on said playing surface, (f) providing a plurality of toss-in cards, each one of said toss-in cards describing an alternate method of scoring and providing instructions for executing said alternate method, each one of said plurality of toss-in cards providing an adjustment of said score for either successfully completing said alternate method or failing to complete said alternate method, (g) providing a plurality of specialty cards, each one of said specialty cards providing an adjustment of said score based upon matching a criterion listed on said specialty card, (h) providing at least one shoe to be worn by at least one player, said shoe facilitating kicking said can, said shoe further comprises a front flat portion operationally coupled to a toe portion of the conventional shoe, a rear flat portion operationally coupled to a heel portion of the conventional shoe, and a pair of side flat portions each operationally coupled to an associated side of the conventional shoe adjacent to a ball portion of the conventional shoe, (i) providing a plurality of iconic members, each one of said iconic members being positionable in an associated one of said plurality of spaces of said goal housing, (j) distributing each one of said iconic members in associated spaces of said goal housing prior to playing an initial turn, (k) using said chance means to determine an order of play for said players, (l) drawing an instruction card, (m) drawing one of said plurality of toss-in cards, (n) following instructions provided on said toss-in card, (o) drawing one of said plurality of specialty cards, (p) following instructions provided on said specialty card, (q) positioning said can along said playing surface as instructed by said instruction card, (r) kicking said can as instructed by said instruction card, (s) adjusting a score based upon results of kicking said can, (t) retrieving one of said plurality of iconic members upon failing to successfully kick said can and said can leaves said playing surface and adjusting said score based upon which iconic member is encountered, (u) retrieving said can, (v) wherein each of said players takes turns drawing instruction cards and kicking said can according to said instruction card, and (w) winning the game by accumulating more points than other players within a predetermined number of turns.

* * * * *